US005554492A

United States Patent [19]

Tsoi

[11] Patent Number: 5,554,492

[45] Date of Patent: Sep. 10, 1996

[54] PHOTOGRAPHIC SILVER HALIDE COLOR MATERIAL

[75] Inventor: Siu C. Tsoi, Watford, England

[73] Assignee: Eastman Kodak Company, Rochester, N.Y.

[21] Appl. No.: 418,706

[22] Filed: Apr. 7, 1995

[30] Foreign Application Priority Data

Apr. 29, 1994 [GB] United Kingdom ..... 9408530

[51] Int. Cl.[6] ..... G03C 1/42; G03C 7/407

[52] U.S. Cl. ..... 430/443; 430/380; 430/478; 430/480; 430/483; 430/486; 430/566; 430/600; 430/613

[58] Field of Search ..... 430/380, 478, 430/443, 480, 483, 486, 543, 566, 600, 613

[56] References Cited

U.S. PATENT DOCUMENTS

| | | | |
|---|---|---|---|
| 3,902,905 | 9/1975 | Bissonette | 430/505 |
| 4,155,763 | 5/1979 | Haseke et al. | 430/469 |
| 4,266,002 | 5/1981 | McCreary et al. | 430/218 |
| 4,409,324 | 10/1983 | Ishikawa et al. | 430/546 |
| 4,456,682 | 6/1984 | Ishikawa et al. | 430/523 |
| 4,465,762 | 8/1984 | Ishikawa et al. | 430/376 |
| 4,483,919 | 11/1984 | Kokayashi et al. | 430/443 |
| 4,845,016 | 7/1989 | Ishikawa et al. | 430/372 |
| 5,242,783 | 9/1993 | Buchanan et al. | 430/446 |

FOREIGN PATENT DOCUMENTS

| | | |
|---|---|---|
| 347848 | 12/1989 | European Pat. Off. . |
| 0394974 | 10/1990 | European Pat. Off. . |
| 139136 | 8/1983 | Japan . |
| 162253 | 8/1985 | Japan . |
| 963988 | 7/1964 | United Kingdom . |
| 9210789 | 6/1992 | WIPO . |

*Primary Examiner*—Hoa Van Le
*Attorney, Agent, or Firm*—Arthur E. Kluegel

[57] ABSTRACT

The invention provides a color photographic material comprising at least one silver halide emulsion layer having associated therewith a dye image-forming coupler and which contains in a layer thereof an ETA (electron transfer agent) releasing compound of the general formula:

(I)

wherein $R^1$ is an alkyl group, $R^2$ to $R^6$ are individually H or an alkyl group with the proviso that when one or both of $R^5$ or $R^6$ are H, $R^3$ and $R^4$ must not be H, $R^7$ to $R^{11}$ are individually H, or an alkyl or alkoxy group, A is H or an alkyl group and B is an alkyl group or, together with the atoms to which they are attached, A and B complete a carbocyclic or heterocyclic ring group, or, when A and B are not linked together, A and $R^2$ may together complete an aromatic or nonaromatic carbocyclic group or an aromatic or nonaromatic heterocyclic group, with the proviso that if $R^7$ to $R^{11}$ are all hydrogen then neither $R_3$ nor $R_4$ are methyl or hydroxymethyl.

8 Claims, 1 Drawing Sheet

PHOTOGRAPHIC SILVER HALIDE COLOR MATERIAL

FIELD OF THE INVENTION

This invention relates to photographic silver halide color materials containing electron transfer agent (ETA) releasing compounds, to the compounds themselves, and to processes for forming a color image in such materials.

BACKGROUND OF THE INVENTION

Our copending application U.S. Ser. No. 08/074,826, filed Jun. 11, 1993, describes a method of developing an image-wise exposed silver halide color material to provide sensitometric results of reduced variability which comprises carrying out color development in the presence of one or a combination of black-and-white silver halide developing agents (termed herein electron transfer agents or ETA's) incorporated in said silver halide color material in an inactive form from which the active form is released during processing. The presence of the agent causes the effect that development is accelerated under low activity development conditions which would normally decrease the rate of development while development is decelerated under high activity development conditions which would normally increase the rate of development. Thus the agent has the effect of reducing the variability in the density versus LogE curve (the characteristic curve) caused by changes in development process variables such as time, temperature, color developing agent concentration and bromide ion concentration. Model examples having the black-and-white silver halide developing agent or ETA present in the developer solution are described in the copending application.

The prior application mentions that, when the black-and-white silver halide developing agent is incorporated in the photographic material, it is preferably in a form which is inactive until processing takes place. For example it may be inactivated by a blocking group which is hydrolyzed off when the material is immersed in the developing solution (which is alkaline).

The specific examples of this application demonstrate the effect of the invention using model experiments with developer solutions containing the effective black-and-white developing agents.

Problem to be Solved by the Invention

The problem with known hydrolyzable blocked pyrazolidone developing agents is that they only unblock at the required pH if the compound is rather unstable. If the compounds are stable enough not to break down in the material, they do not unblock fast enough (or at all) to be useful. A problem to be solved is to provide a photographic material containing an ETA which is stable during keeping but which is capable of unblocking during development in order to help minimize the effects of development process variables on image density.

SUMMARY OF THE INVENTION

According to the present invention there is provided a color photographic material comprising at least one silver halide emulsion layer having associated therewith a dye image-forming coupler and which contains in a layer thereof an ETA releasing compound of the general formula:

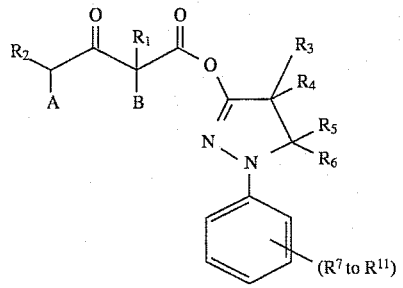

(I)

wherein $R^1$ is an alkyl group, $R^2$ to $R^6$ are individually H or an alkyl group with the proviso that when one or both of $R^5$ or $R^6$ are H, $R^3$ and $R^4$ must not be H, $R^7$ to $R^{11}$ are individually H, or an alkyl or alkoxy group, A is H or an alkyl group and B is an alkyl group or, together with the atoms to which they are attached, A and B complete a carbocyclic or heterocyclic ring group, or, when A and B are not linked together, A and $R^2$ may together complete an aromatic or nonaromatic carbocyclic group or an aromatic or nonaromatic heterocyclic group, with the proviso that if $R^7$ to $R^{11}$ are all hydrogen then neither $R_3$ nor $R_4$ are methyl or hydroxymethyl.

The invention also encompasses the ETA releasing compound and the process for forming an image in the described photographic material.

Advantageous Effect of the Invention

The invention provides a photographic material containing an ETA which is stable during keeping but which is capable of unblocking during development in order to help minimize the effects of development process variables on image density.

DETAILED DESCRIPTION OF THE INVENTION

Figure 1:
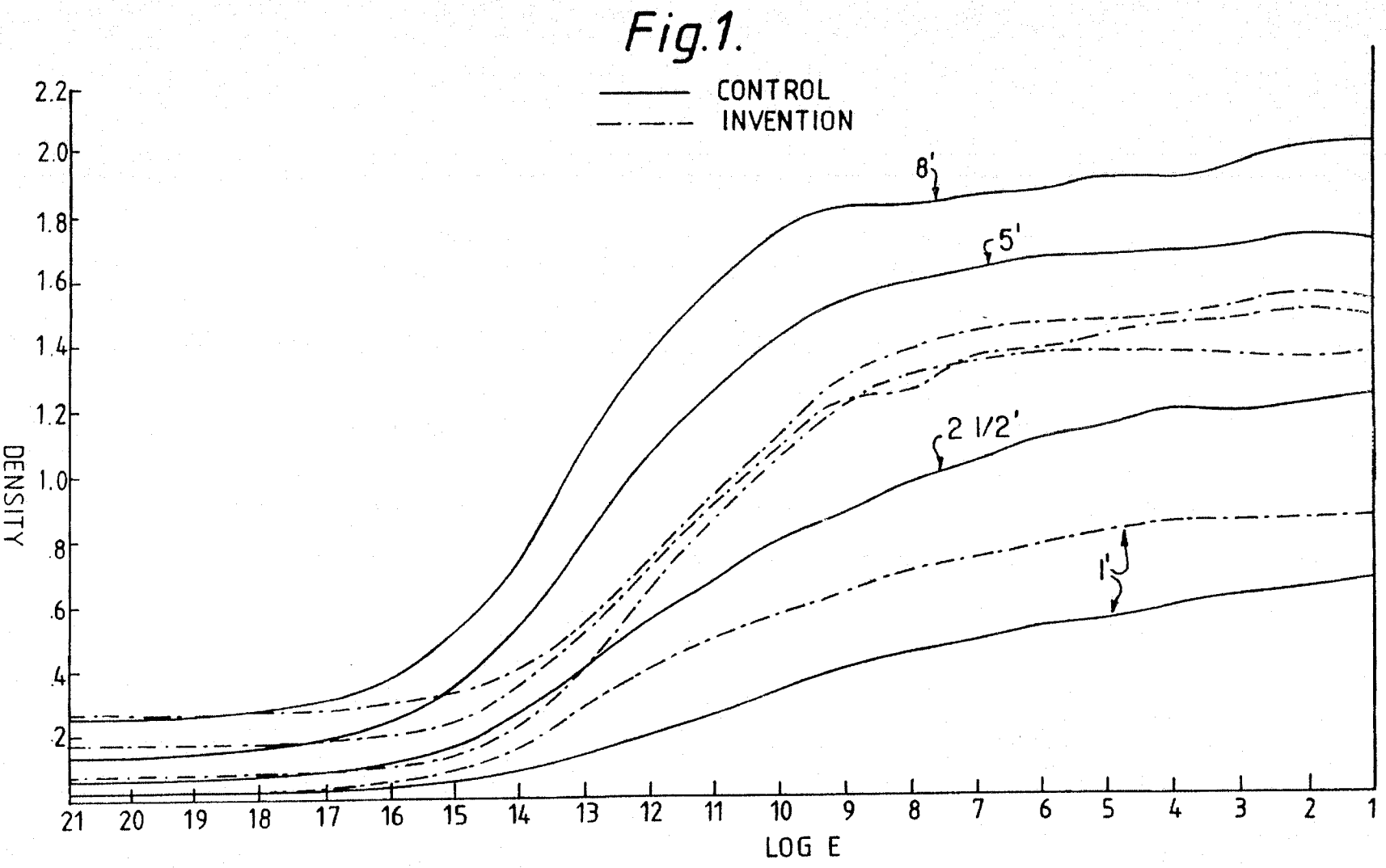
FIG. 1 of the accompanying drawings illustrates the results of Example 2 below.

It has been demonstrated that certain blocked ETA's, where the 4- and the 5-positions of the pyrazolidin-3-one each have at least one proton available, will undergo undesirable reactions to give as illustrated in Scheme 1 below. Accordingly, such compounds are unsuitable for ETA applications.

Scheme 1

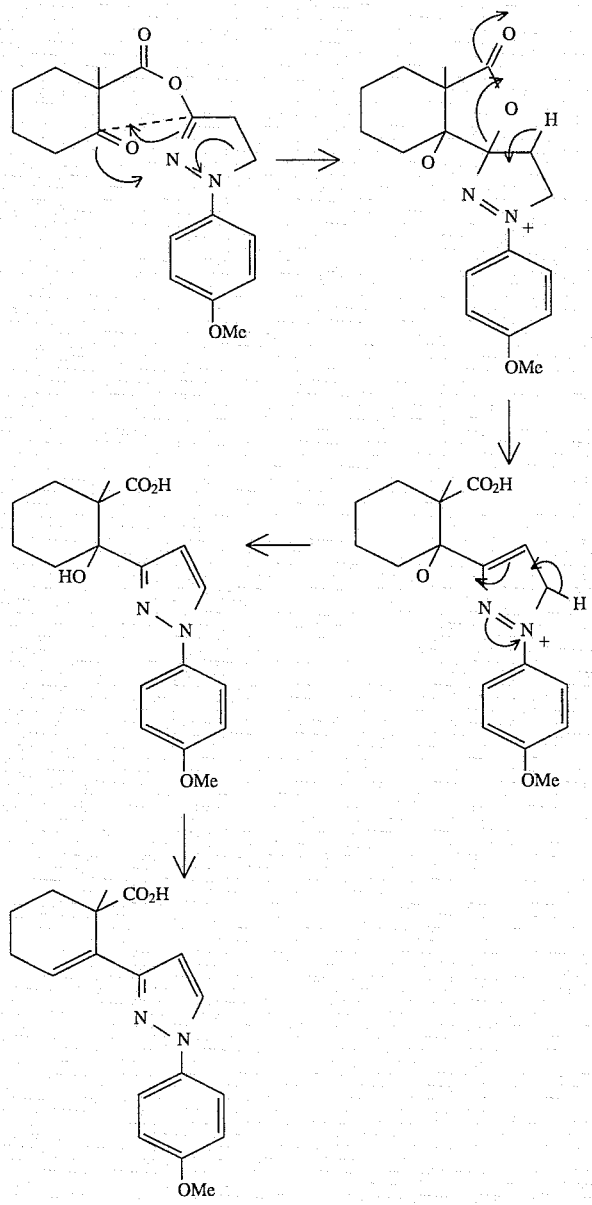

It has been found that the present blocked ETA's are of sufficient size and molecular weight to prevent them from wandering in photographic coatings without any added ballast. The present compounds therefore have the advantages of easier and shorter synthesis and hence are more easily manufactured at lower cost.

The alkyl groups represented by any of $R^1$ to $R^{11}$ are suitably alkyl groups having 1 to 25 carbon atoms, preferably 1 to 6 carbon atoms. The alkoxy groups represented by $R^7$ to $R^{11}$ may have the same range of carbon atoms. The alkyl or alkoxy groups may include, for example, substituents such as halogen, alkyl, alkoxy, acyloxy, aroyloxy, keto, ether, ester, sulphonamide, sulphamoyl, carbonamide, and carbamoyl groups.

The ETA compounds released by the compounds described above preferably have the general formula:

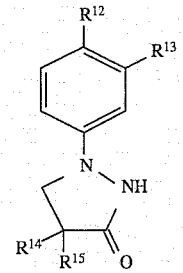

(II)

wherein $R^{12}$ and $R^{13}$ are each hydrogen or an alkyl or alkoxy group having 1-16 carbon atoms, $R^{14}$ and $R^{15}$ are each an alkyl group having 1–10 carbon atoms, with the proviso that if $R^{12}$ and $R^{13}$ are hydrogen then neither $R^{14}$ nor $R^{15}$ are either methyl or hydroxymethyl. These ETA groups belong to type (1) described below.

As is known from PCT publication WO 92/10789, there are three types of behavior observed with different types of pyrazolidinone compounds. The reduction of sensitivity to development time is used as an example. Three broad types of behavior for different ETA's can be observed and these are as follows:

Type (1): A reduction of sensitometric spread with a retardation of overdevelopment and an acceleration of the underdevelopment.

Type (2): A modest reduction of sensitometric spread with a general acceleration of dye formation.

Type (3): A reduction in sensitometric spread with a general retardation of dye formation.

The use of Type (3) ETA's alone is therefore not part of the present invention.

Type (1) is the preferred behavior exhibited by the preferred compounds especially when used singly. Type (2) is another useful and beneficial behavior and could, in certain cases, be preferred over Type (1) if an increase in contrast or corresponding trade-off was desired.

The present invention also includes the use of combinations of ETA's. Combinations of Type (2) and (3), for example, can give an overall behavior similar to or better than Type (1). Combinations of Type (1) and (3) also give good results in that the spread of the sensitometric curves is particularly well controlled.

Suitable "Type (2)" ETA groups may be of formula II in which $R^{12}$, $R^{13}$ are hydrogen or alkyl of 1–3 carbon atoms and $R^{14}$ and $R^{15}$ are an alkyl or hydroxyalkyl group of 1–3 carbon atoms, e.g. $—CH_2OH$ or $—C_3H_7$.

Suitable "Type (3)" ETA groups may be of formula II in which $R^{12}$ to $R^{15}$ are each hydrogen or alkyl groups of 1–12 carbon atoms or alkoxy groups of 1–12 carbon atoms where the total number of carbon atoms is equal to or greater than 4. Hence to obtain the desired effect Types 2 and 3 may be used in combination or type 1 may be used alone. In practice any suitable combination of 2 or more types may be used. Their effect is easily determined by experiment.

It is recognized that the definitions of the above types of ETA are not mutually exclusive. This is because it is difficult to find an appropriate definition which is mutually exclusive. Examples of the three types are given below. Beyond that the skilled worker will be able to determine to which type a particular ETA belongs by carrying out the procedures described herein.

Specific examples of compounds of formula (I) above include those of the formulae:
(1)
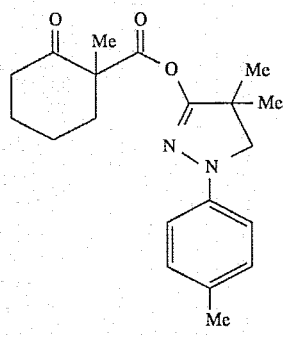
(2)
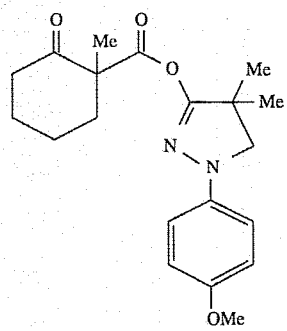
(3)
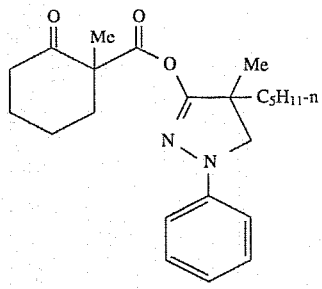
(4)
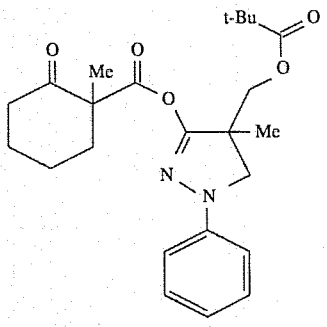
(5)
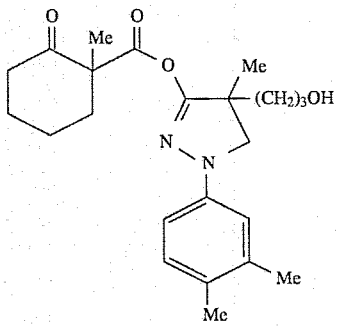
-continued
(6)
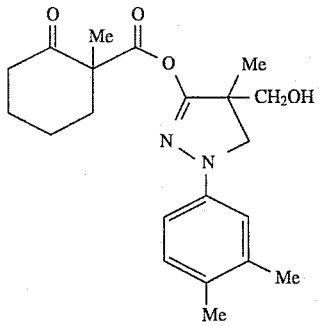
(7)
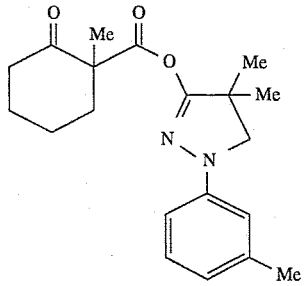
(8)
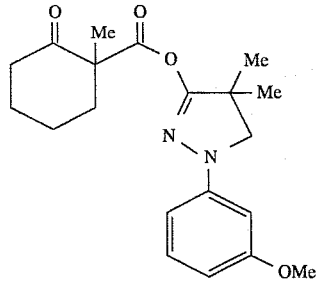
(9)
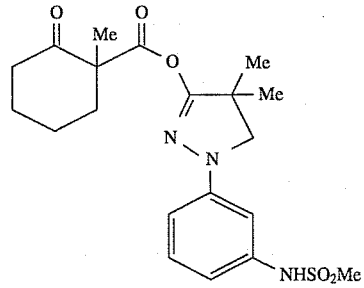
(10)
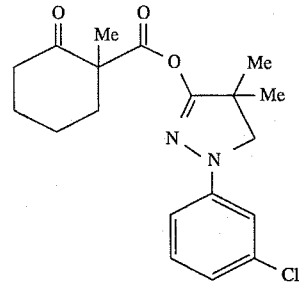

-continued
(11)
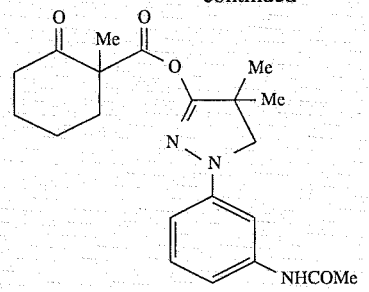
(12)
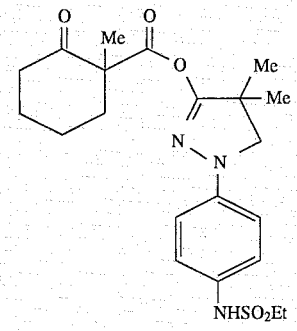
(13)
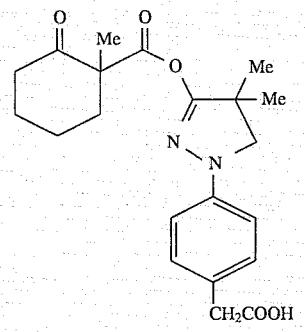
(14)
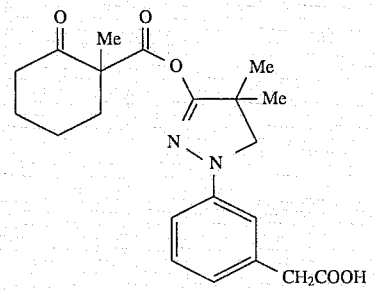
(15)
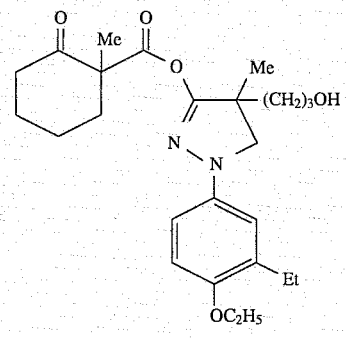
-continued
(16)
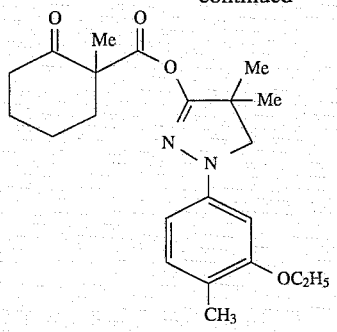
(17)
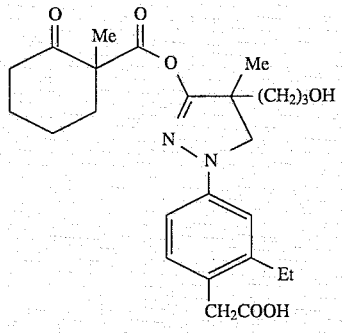
(18)
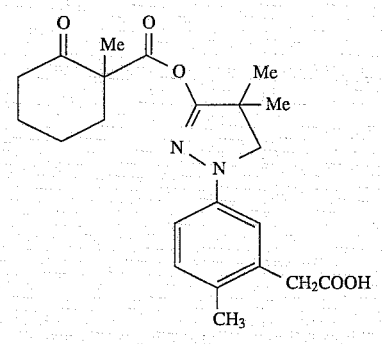
(19)
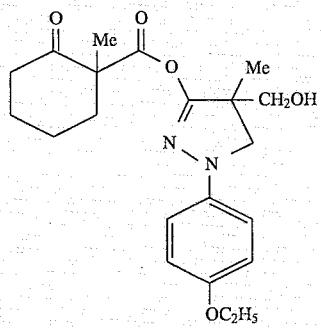
(20)
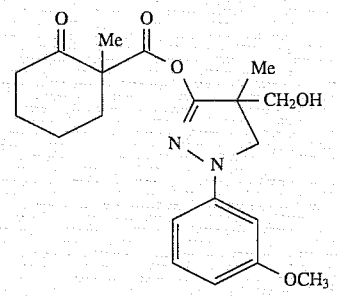

-continued (21)

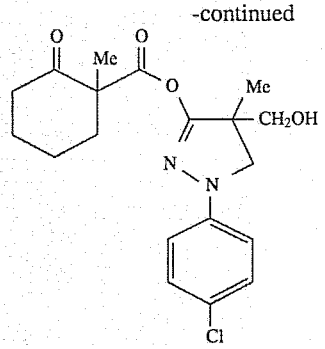

(22)

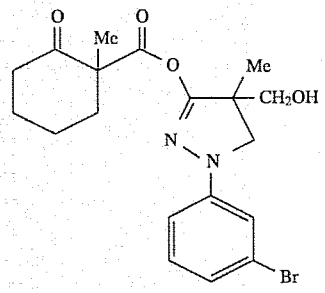

(23)

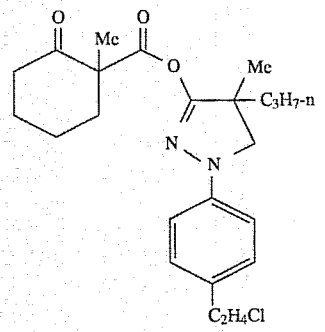

(24)

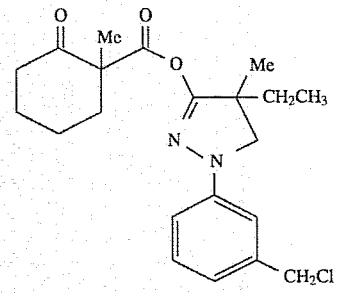

The compounds of formula (I) may be incorporated into the photographic materials by methods, in themselves, known. For example they may be dispersed therein in a high-boiling organic solvent, often known as a "coupler solvent". Examples of such solvents are triphenylphosphate, and dibutylphthalate. Normally the coupler is dissolved in the coupler solvent or mixture of solvents and this liquid is dispersed, in the presence of a dispersing agent, in an aqueous gelatin solution. Sometimes a low boiling solvent is used in the coupler solvent mixture but this is removed after the dispersion has been formed.

The present invention is particularly concerned with color negative film but it is also applicable to other materials, e.g. color paper.

The photographic material may comprise a support bearing at least one silver halide emulsion layer having a color coupler associated therewith. The term "associated therewith" here takes its normal meaning in art. The coupler may be incorporated in the emulsion layer or in a layer adjacent thereto. The preferred color materials comprise three dye image forming units each containing one or more emulsion layers having couplers associated therewith and each sensitised to a different region of the spectrum. A typical color material would contain such units sensitised to blue, green and red light and capable of forming yellow, magenta and cyan image dyes respectively.

Examples of color photographic materials and methods of processing them are described in Research Disclosure Item 308119, December 1989 published by Kenneth Mason Publications, Emsworth, Hants, United Kingdom.

The present invention also provides A method of processing an imagewise exposed color photographic material of the present invention which includes the step of treating the material with a photographic color developer.

In a further embodiment of the present method of processing the color developer solution contains an ETA compound. Preferably this ETA compound is a 1-aryl-pyrazolidin-3-one.

In a preferred embodiment, the compounds of formula (I) and the ETA's of formula (II) are chosen so that the low activity development is accelerated and the high activity development decelerated thus leading to less variation in sensitometric results under both high and low activity conditions.

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy)butyramido, alpha-(3-pentadecylphenoxy)hexanamido, alpha-(4-hydroxy-3-t-butylphenoxy)-tetradecanamido, 2-oxopyrrolidin-1-yl, 2-oxo-5 -tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5 -(di-t-pentylphenyl) carbonylamino, p-dodecylphenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5 -di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4 -di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2 -ethylhexyloxysulfonyl, phenoxysulfonyl, 2,4 -di-t-pentylphenoxysulfonyl methylsulfonyl, octylsulfonyl, 2 -ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy)ethylthio, phenylthio, 2 -butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a silver halide emulsion and the emulsion coated as a layer on a support to form part of a photographic element. Alternatively, they can be incorporated at a location adjacent to the silver halide emulsion layer where, during development, they will be in reactive association with development products such as oxidized color developing agent. Thus, as used herein, the term "associated" signifies that the compound is in the silver halide emulsion layer or in an adjacent location where, during processing, it is capable of reacting with silver halide development products.

To control the migration of various components, it may be desirable to include a high molecular weight hydrophobe or "ballast" group in the component molecule. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire P010 7DQ, ENGLAND, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1994, Item 36544, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

The silver halide emulsions employed in the elements of this invention can be either negative-working or positive-working. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Scan facilitating is described in Section XIV. Supports, exposure, development systems, and processing methods and agents are described in Sections XV to XX. Certain desirable photographic elements and processing steps, particularly those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction and the like.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl, sulfonamido, mercaptotetrazole, benzothiazole, mercaptopropionic acid, phosphonyloxy, arylthio, and arylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: UK. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dyeformation. Thus, for example, a naphthol having an unsubstituted carbamoyl or one substituted with a low molecular weight substituent at the 2- or 3-position may be employed. Couplers of this type are described, for example, in U.S. Patent Nos. 5,026,628, 5,151,343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers may be shifted or blocked, if desired.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; UK. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. Nos. 4,366,237; EP 96,570; 4,420,556; and 4,543,323.) Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

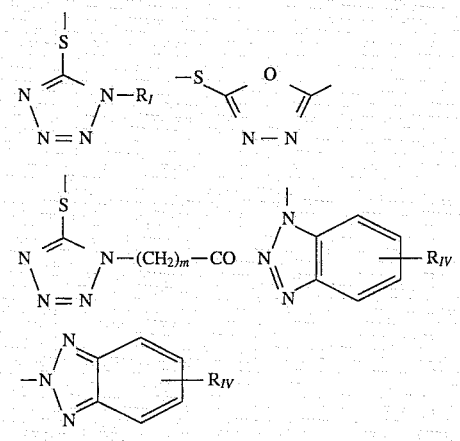

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

As mentioned, the developer inhibitor-releasing coupler may include a timing group, which produces the time-delayed release of the inhibitor group such as groups utilizing the cleavage reaction of a hemiacetal (U.S. Pat. No. 4,146,396, Japanese Applications 60-249148; 60-249149); groups using an intramolecular nucleophilic substitution reaction (U.S. Pat. No. 4,248,962); groups utilizing an electron transfer reaction along a conjugated system (U.S. Pat. No. 4,409,323; 4,421,845; Japanese Applications 57-188035; 58-98728; 58-209736; 58 209738) groups utilizing ester hydrolysis (German Patent Application (OLS) No. 2,626,315); groups utilizing the cleavage of imino ketals (U.S. Pat. No. 4,546,073); groups that function as a coupler or reducing agent after the coupler reaction (U.S. Pat. No. 4,438,193; U.S. 4,618,571) and groups that combine the features describe above. It is typical that the timing group or moiety is of one of the formulas:

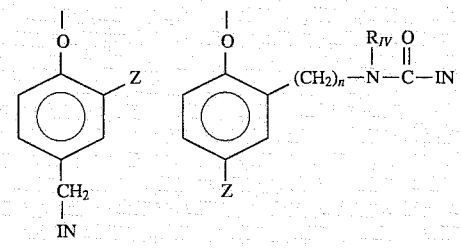

wherein IN is the inhibitor moiety, Z is selected from the group consisting of nitro, cyano, alkylsulfonyl; sulfamoyl (—$SO_2NR_2$); and sulfonamido (—$NRSO_2R$) groups; n is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

Suitable developer inhibitor-releasing couplers for use in the present invention include, but are not limited to, the following:

D1

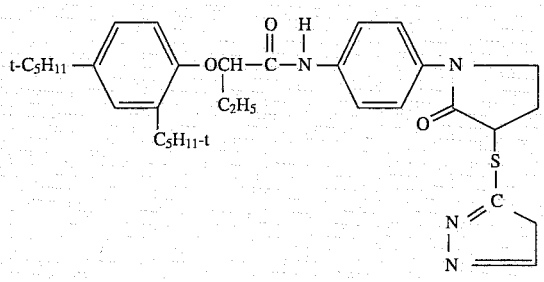

D2

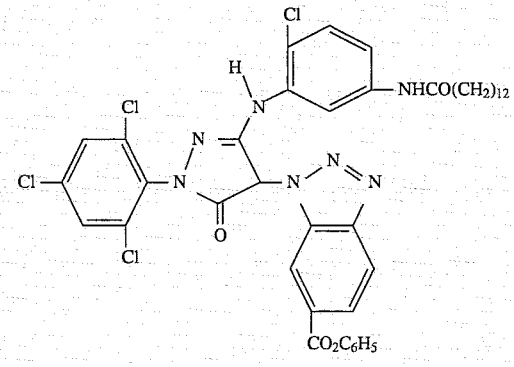

-continued
D3
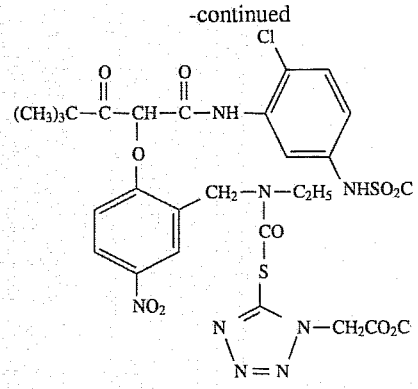
D4
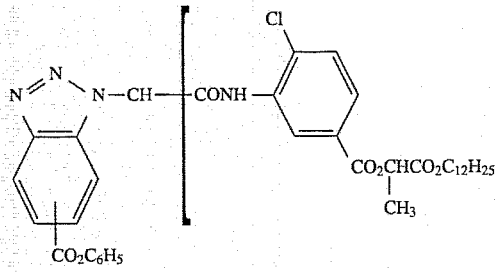
D5
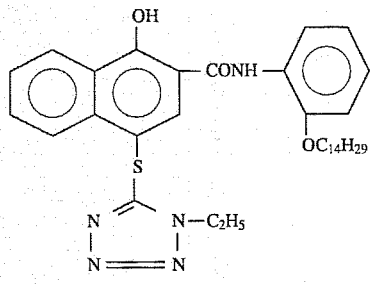
D6
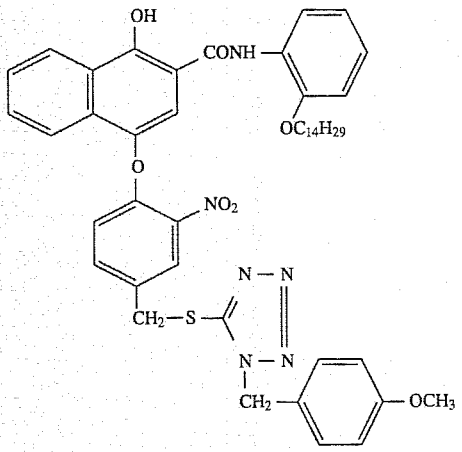
-continued
D7
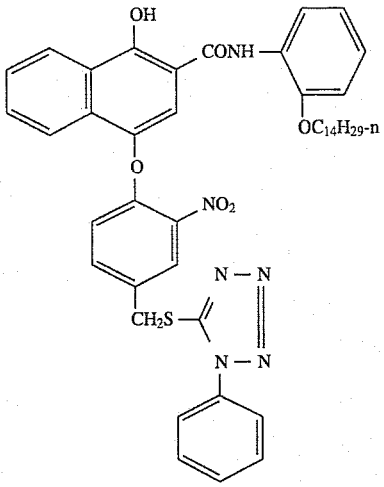
D8
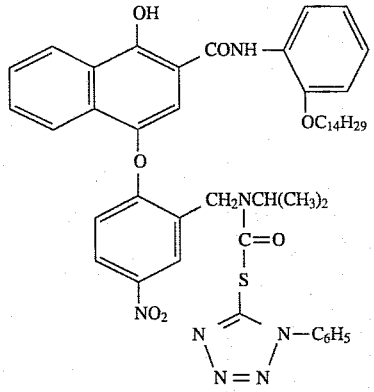
D9
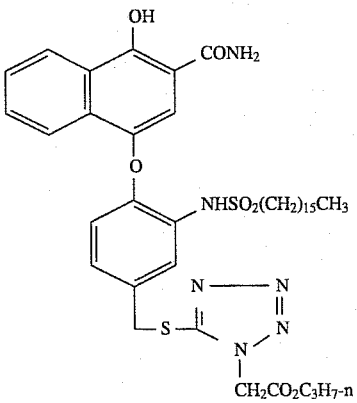
D10
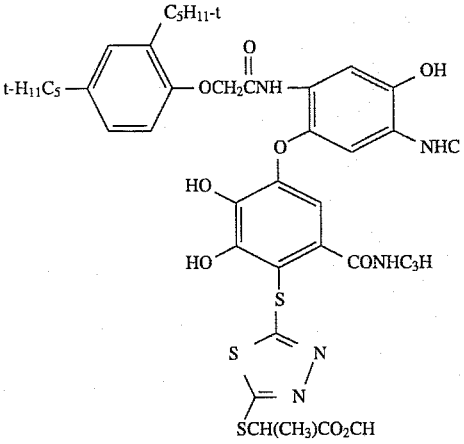

It is also contemplated that the concepts of the present invention may be employed to obtain reflection color prints as described in *Research Disclosure,* November 1979, Item 18716, available from Kenneth Mason Publications, Ltd, Dudley Annex, 12a North Street, Emsworth, Hampshire P0101 7DQ, England, incorporated herein by reference. Materials of the invention may be coated on pH adjusted support as described in U.S. 4,917,994; on a support with reduced oxygen permeability (EP 553,339); with epoxy solvents (EP 164,961); with nickel complex stabilizers (U.S. Pat. Nos. 4,346,165; 4,540,653 and 4,906,559 for example); with ballasted chelating agents such as those in U.S. Pat. No. 4,994,359 to reduce sensitivity to polyvalent cations such as calcium; and with stain reducing compounds such as described in U.S. Pat. No. 5,068,171. Other compounds useful in combination with the invention are disclosed in Japanese Published Applications described in Derwent Abstracts having accession numbers as follows: 90-072,629, 90-072,630; 90-072,631; 90-072,632; 90-072,633; 90-072, 634; 90-077,822; 90-078,229; 90-078,230; 90-079,336; 90-079,337; 90-079,338; 90-079,690; 90-079,691; 90-080, 487; 90-080,488; 90-080,489; 90-080,490; 90-080,491; 90-080,492; 90-080,494; 90-085,928; 90- 086,669; 90-086, 670; 90-087,360; 90-087,361; 90-087,362; 90-087,363; 90-087,364; 90-088,097; 90-093,662; 90-093,663; 90-093, 664; 90-093,665; 90-093,666; 90-093,668; 90-094,055; 90-094,056; 90-103,409; 83-62,586; 83-09,959.

Especially useful in this invention are tabular grain silver halide emulsions. Specifically contemplated tabular grain emulsions are those in which greater than 50 percent of the total projected area of the emulsion grains are accounted for by tabular grains having a thickness of less than 0.3 micron (0.5 micron for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in micrometers and t is the average thickness in micrometers of the tabular grains.

The average useful ECD of photographic emulsions can range up to about 10 micrometers, although in practice emulsion ECD's seldom exceed about 4 micrometers. Since both photographic speed and granularity increase with increasing ECD's, it is generally preferred to employ the smallest tabular grain ECD's compatible with achieving aim speed requirements.

Emulsion tabularity increases markedly with reductions in tabular grain thickness. It is generally preferred that aim tabular grain projected areas be satisfied by thin (t<0.2 micrometer) tabular grains. To achieve the lowest levels of granularity it is preferred that aim tabular grain projected areas be satisfied with ultrathin (t<0.06 micrometer) tabular grains. Tabular grain thicknesses typically range down to about 0.02 micrometer. However, still lower tabular grain thicknesses are contemplated. For example, Daubendiek et al U.S. Pat. No. 4,672,027 reports a 3 mole percent iodide tabular grain silver bromoiodide emulsion having a grain thickness of 0.017 micrometer. Ultrathin tabular grain high chloride emulsions are disclosed by Maskasky U.S. Pat. No. 5,217,858.

As noted above tabular grains of less than the specified thickness account for at least 50 percent of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70 percent of the total grain projected area. In the highest performance tabular grain emulsions, tabular grains satisfying the thickness criteria above account for at least 90 percent of total grain projected area.

Suitable tabular grain emulsions can be selected from among a variety of conventional teachings, such as those of the following:

Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. The described elements can be processed in the known C-41 color process as described in The British Journal of Photography Annual of 1988, pages 191–198. Where applicable, the element may be processed in accordance with color print processes such as the RA-4 process of Eastman Kodak Company as described in the British Journal of Photography Annual of 1988, Pp 198–199. To provide a positive (or reversal) image, the color development step can be preceded by development with a non-chromogenic developing agent to develop exposed silver halide, but not form dye, and followed by uniformly fogging the element to render unexposed silver halide developable. Alternatively, a direct positive emulsion can be employed to obtain a positive image.

Preferred color developing agents are p-phenylenediamines such as:

4-amino-N,N-diethylaniline hydrochloride, 4-amino-3-methyl-N,N-diethylaniline hydrochloride, 4-amino-3-methyl-N-ethyl-N-(β-(methanesulfonamido) ethyl)aniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

The entire contents of the various patents and other publications cited in this specification are incorporated herein by reference.

The following Examples are included for a better understanding of the invention.

Preparative Example

To a solution of 4,4-dimethyl-l-(4-methoxyphenyl)-3-pyrazolidinone (10.5 g, 47.7 mmol) in dry pyridine (100 ml) and triethylamine (20 ml) was added dropwise, with stirring, 1-methyl-2-oxocyclohexanoyl chloride (9.1 g, 50 mmol) over a period of 15 minutes at about 5° C. After the addition was completed, the mixture was stirred at 5° C. for a further hour and then overnight at room temperature. The reaction mixture was poured into a rapidly stirred mixture of ice/water and conc. HCl (135ml). The solid was collected by filtration and washed well with water to give a brown solid. Recrystallisation from methanol gave the required product as a pale pink solid.

Yield: 10.9 g (64%).

1H NMR ($CDCl_3$) 7.0–6.8 ($A_2B_2$ pattern, 4H), 3.8 (s, 3H), 3.6 (s, 2H), 2.6–2.5 (m, 3H), 2.1–2.0 (m, 1H), 1.9–1.5 (m, 4H), 1.4 (s, 3H) and 1.2 (2×s, 6H) ppm.

13C NMR ($CDCl_3$) 207.0, 170.5, 158.9, 154.0, 141.9, 115.1, 114.6, 65.8, 57.6, 55.8, 45.1, 40.5, 38.1, 27.5, 23.6, 23.5, 22.4 and 21.2 ppm.

Found C, 67.11; H, 7.07; N, 7.83 $C_{20}H_{26}N_2O_4$ requires: C, 67.01; H, 7.31; N, 7.82

EXAMPLE 1

Compound (2) was made into a dispersion in coupler solvent (1) (diethyl lauramide) and solvent (2) (ethyl acetate) in the ratio, (Compound (2):Solvent (1): Solvent (2)) by weight of 1:2:3. The oil phase was then dispersed in gelatin to give 1.0% Compound 1, 4.0% gelatin.

Coatings were then made in which compound (2) was coated in a layer underneath a layer containing the silver halide and coupler. This is shown in the table 1 below.

TABLE 1

| Coating Format for Incorporated Blocked ETA | |
|---|---|
| Gelatin | (1.0 g/sq. m) |
| Coupler 1 | (0.6 g/sq. m) |
| Tabular grain silver bromoiodide emulsion (speed = 400 ASA) | (1.0 g/sq. m) |
| Gelatin | (2.7 g/sq. m) |
| Tetraazaindene (antifoggant) | 30 ml/mole Ag |
| Compound 2 | (0.8 g/sq. m) |
| Gelatin | (2.7 g/sq. m) |
| Filmbase | |

The ETA released from the blocked ETA is 4'-methoxyphenyl-4,4-dimethyl-pyrazolidin-3-one.

Coupler (1) has the formula:

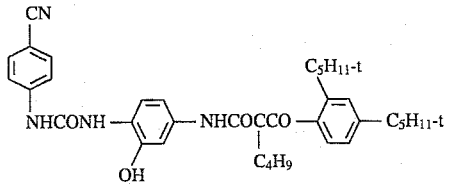

EXAMPLE 2

The coatings of Example 1 were processed in standard C-41 developer containing 3 g/l hyroxylamine sulphate for the following development times; 1, 2.5, 5 and 8 minutes. In FIG. 1 the sensitometric response of the control coating (no blocked ETA) for these four development times is shown. It can be seen that, with blocked ETA present, the sensitometric spread is reduced, ie. the 5 and 8 minute samples have reduced density while the 1 and 2.5 minute samples have increased density.

What is claimed is:

1. A color photographic material comprising at least one silver halide emulsion layer having associated therewith a dye image-forming coupler and which contains in a layer thereof an ETA (electron transfer agent) releasing compound of the general formula:

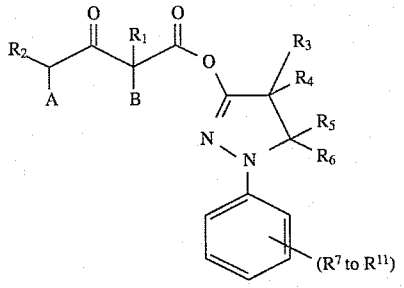

(I)

wherein $R^1$ is an alkyl group, $R^2$ to $R^6$ are individually H or an alkyl group with the proviso that when one or both of $R^5$ or $R^6$ are H, $R^3$ and $R^4$ must not be H, $R^7$ to $R^{11}$ are individually H, or an alkyl or alkoxy group, A is H or an alkyl group and B is an alkyl group or, together with the atoms to which they are attached, A and B complete a carbocyclic or heterocyclic ring group, or, when A and B are not linked together, A and $R^2$ may together complete an aromatic or nonaromatic carbocyclic group or an aromatic or nonaromatic heterocyclic group, with the proviso that if $R^7$ to $R^{11}$ are all hydrogen then neither $R_3$ nor $R_4$ are methyl or hydroxymethyl.

2. A material as claimed in claim 1 in which $R^2$ to $R^{11}$ are substituted with a group selected from the group consisting of halogen and alkyl, alkoxy, keto, ether, ester, sulphonamide, sulphamoyl, carbonamide, and carbamoyl groups.

3. A material as claimed in claim 1 in which the ETA released has the general formula:

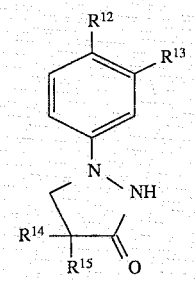

(II)

wherein $R^{12}$ and $R^{13}$ are each hydrogen or an alkyl or alkoxy group having 1–16 carbon atoms, $R^{14}$ and $R^{15}$ are each an alkyl group having 1–10 carbon atoms with the proviso that if $R^{12}$ and $R^{13}$ are hydrogen then neither $R^{14}$ nor $R^{15}$ are methyl or hydroxymethyl.

4. A material as claimed in claim 1 in which the alkyl groups represented by any of $R^1$ to $R^{11}$ are alkyl groups having 1 to 25 carbon atoms.

5. A method of processing a color photographic material as claimed in claim 1 after the same has been image-wise exposed, which includes the step of treating the material with a photographic color developer.

6. A method of processing as claimed in claim 5 in which the color developer solution contains an ETA compound.

7. A method of processing as claimed in claim 6 in which the ETA compound contains a 1-arylpyrazolidin-3-one group.

8. A method as claimed in claim 6 in which the incorporated ETA(s) of formula (I) and the ETA's in the color developer solution are chosen so that the low activity development is accelerated and the high activity development decelerated thus leading to less variation in sensitometric results under both high and low activity conditions.

* * * * *